US008533996B1

(12) United States Patent
Stone

(10) Patent No.: US 8,533,996 B1
(45) Date of Patent: Sep. 17, 2013

(54) SHUTTER DRIVE APPARATUS

(76) Inventor: Lawrence Matthew Stone, Logan, UT (US)

( * ) Notice: Subject to any disclaimer, the term of this patent is extended or adjusted under 35 U.S.C. 154(b) by 0 days.

(21) Appl. No.: 13/470,276

(22) Filed: May 12, 2012

Related U.S. Application Data

(60) Provisional application No. 61/632,049, filed on Jan. 17, 2012, provisional application No. 61/626,195, filed on Sep. 22, 2011.

(51) Int. Cl.
*E06B 7/096* (2006.01)
*E06B 7/08* (2006.01)

(52) U.S. Cl.
USPC ..... 49/82.1; 49/74.1; 49/403

(58) Field of Classification Search
USPC ..... 49/82.1, 74.1, 403, 87.1
See application file for complete search history.

(56) References Cited

U.S. PATENT DOCUMENTS

| | | | | | |
|---|---|---|---|---|---|
| 595,854 | A * | 12/1897 | Lansing | 49/82.1 |
| 3,746,042 | A * | 7/1973 | Finkel | 137/601.06 |
| 4,860,492 | A * | 8/1989 | Roy | 49/82.1 |
| 5,052,150 | A | 10/1991 | Chen | 49/84 |
| 5,216,837 | A * | 6/1993 | Cleaver et al. | 49/82.1 |
| 5,379,551 | A | 1/1995 | Swapp | 49/82.1 |
| 5,842,919 | A | 12/1998 | Lyons et al. | 454/336 |
| 6,145,251 | A * | 11/2000 | Ricci | 49/82.1 |
| 6,536,162 | B2 | 3/2003 | LaMay | 49/403 |
| 6,701,669 | B1 * | 3/2004 | Yorgason | 49/82.1 |
| 6,761,203 | B1 * | 7/2004 | Huang | 160/170 |
| 6,848,213 | B1 * | 2/2005 | Swapp | 49/82.1 |
| 7,124,537 | B2 * | 10/2006 | Young | 49/74.1 |
| 7,353,636 | B1 * | 4/2008 | Anderson et al. | 49/82.1 |
| 7,389,609 | B2 | 6/2008 | Yorgason | 49/82.1 |
| 2005/0252086 | A1 | 11/2005 | Yorgason | 49/82.1 |
| 2005/0257429 | A1 * | 11/2005 | Yorgason | 49/82.1 |
| 2011/0126464 | A1 * | 6/2011 | Stone et al. | 49/82.1 |

* cited by examiner

*Primary Examiner* — Katherine Mitchell
*Assistant Examiner* — Scott Denion
(74) *Attorney, Agent, or Firm* — Michael R. Schramm

(57) ABSTRACT

The shutter drive apparatus is an apparatus adapted such that the movement of any one shutter louver of a tilt-rod-less shutter results in the corresponding movement of all of the louvers of the shutter. The apparatus is preferably mounted within a tilt-rod-less shutter comprising a shutter frame having at least top and bottom horizontal rails, at least a first side stile and a second side stile, and a plurality of louvers rotatably mounted within the stiles such that a first end of the louvers are freely rotatable within the first side stile, and such that a second end of the louvers are drivably engaged to the apparatus. The apparatus includes a plurality of pinion gears, a face strip, opposing drive strips, and a retainer strip. Each louver is drivably engaged to a different pinion gear and each pinion gear is drivably engaged to the drive strips.

20 Claims, 12 Drawing Sheets

SHUTTER DRIVE APPARATUS

CROSS REFERENCE TO RELATED APPLICATIONS

This nonprovisional utility patent application claims the benefit under 35 USC §119(e) of U.S. provisional application No. 61/626,195 filed Sep. 22, 2011 and of U.S. provisional application No. 61/632,049 filed Jan. 17, 2012 both of which are incorporated, in their entirety, by this reference.

BACKGROUND

The present invention relates generally to window covering shutters such as plantation style shutters and their respective drive systems. More particularly, the present invention relates to "tilt-rod-less" shutters and drive systems that are adapted such that the movement of (any) one shutter louver (e.g. the opening or closing of one louver) results in the corresponding movement (slaved movement) of all of the shutter louvers.

RELATED ART

Window cover type shutters are well known and have long been used to not only improve home décor, but to allow for the amount and direction of light allowed to pass through a cover window and into a room (see appendix A to this specification) . While such use of shutters have been both decorative and functional, a problem with many such shutters is that the tilt rod used to position the louvers of such shutters has restricted the range of motion of such louvers such that the louvers of the shutter are not completely closeable. Various solutions to the problem of incomplete louver closure, such as creating pockets in the rails to receive the ends of a tilt rod, and thus allow for a greater range of motion of the louvers have been devised. Moreover, a preferred method of increasing the range of motion and an especially aesthetically pleasing solution, is to completely eliminate the tilt rod from the shutter. However, in such "tilt-rod-less" configurations, unless each louver is to be separately adjustable (a very cumbersome and impractical configuration), a drive mechanism is required such to adapt the shutter such that the movement of (any) one shutter louver (e.g. the opening or closing of one louver) results in the corresponding movement (slaved movement) of all of the shutter louvers.

SUMMARY

The invention is a shutter drive apparatus adapted such that the movement of (any) one shutter louver (e.g. the opening or closing of one louver) results in the corresponding movement (slaved movement) of all of the shutter louvers. The shutter defines a preferably tilt-rod-less shutter comprising a shutter frame having at least top and bottom horizontal rails, at least a first side stile and a second side stile, and a plurality of louvers (slats or blades) rotatably mounted within the stiles such that a first end of the louvers are freely rotatable within the first side stile, and such that a second end of the louvers are drivably engaged to the shutter drive apparatus. The shutter drive apparatus is preferably mounted within the second stile and preferably includes a plurality of pinion gears, a face strip, opposing drive strips, and a retainer strip. Each louver is drivably engaged to a different pinion gear and each pinion gear is drivably engaged to the drive strips such that movement of (any) one shutter louver (e.g. the opening or closing of one louver) results in the corresponding movement (slaved movement) of all of the shutter louvers. The shutter drive apparatus is adapted to require minimal (different) parts and to be of low manufacturing cost.

BRIEF DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
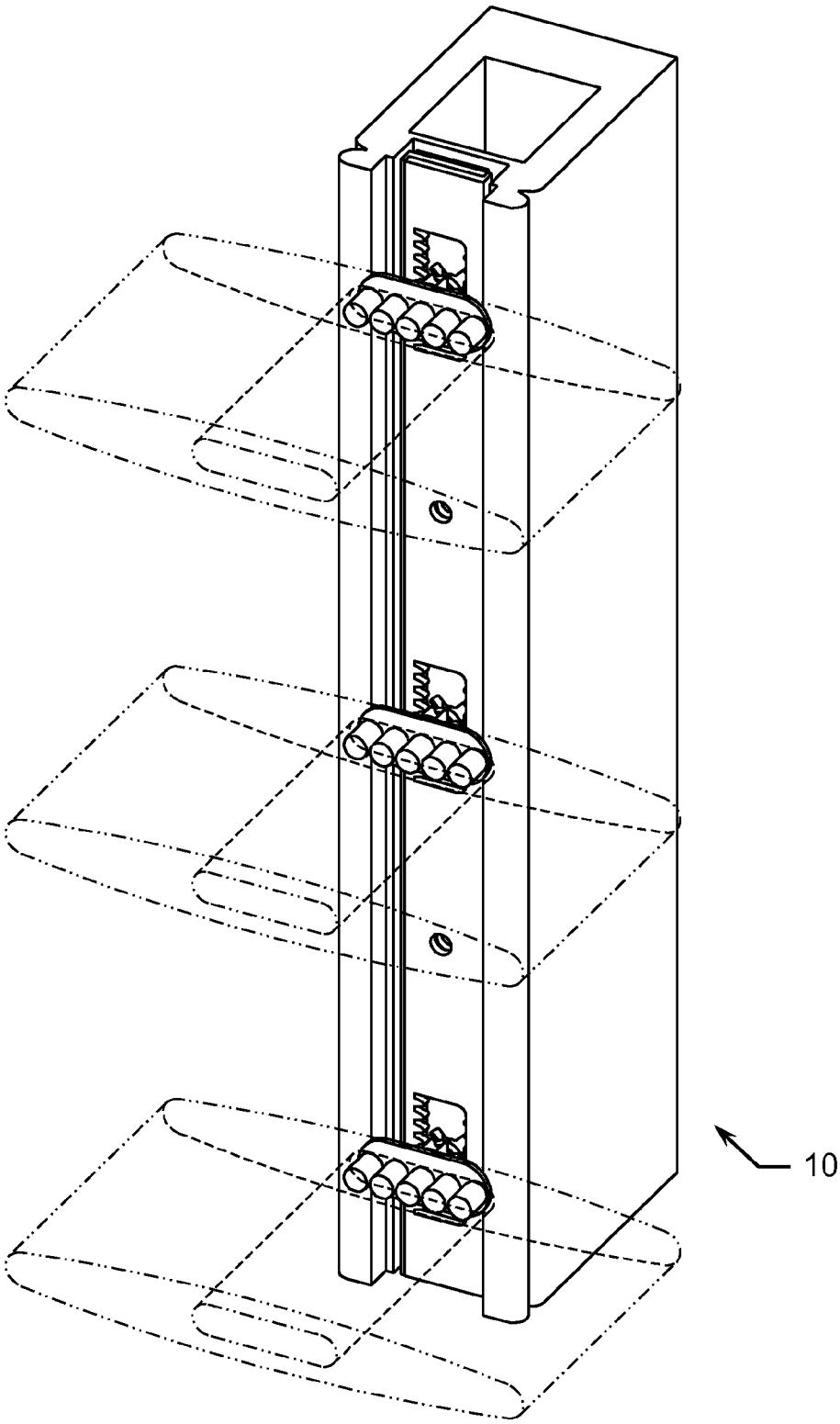
FIG. 1 is a substantially trimetric view of a first embodiment of the present invention with the louvers shown in phantom lines.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

The invention is a shutter drive apparatus adapted such that the movement of (any) one shutter louver (e.g. the opening or closing of one louver) results in the corresponding movement (slaved movement) of all of the shutter louvers. The shutter defines a preferably tilt-rod-less shutter comprising a shutter frame having at least top and bottom horizontal rails, at least a first side stile and a second side stile, and a plurality of louvers (slats or blades) rotatably mounted within the stiles such that a first end of the louvers are freely rotatable within the first side stile, and such that a second end of the louvers are drivably engaged to the shutter drive apparatus. The shutter drive apparatus is preferably mounted within the second stile and preferably includes a plurality of pinion gears, a face strip, opposing drive strips, and a retainer strip. Each louver is drivably engaged to a different pinion gear and each pinion gear is drivably engaged to the drive strips such that movement of (any) one shutter louver (e.g. the opening or closing of one louver) results in the corresponding movement (slaved movement) of all of the shutter louvers.

In order to facilitate the understanding of the present invention in reviewing the drawings accompanying the specification, a feature list is provided below. It is noted that like features are like numbered throughout all of the figures.

FEATURE TABLE

| # | Feature | # | Feature |
|---|---|---|---|
| 10 | Shutter drive apparatus | | |
| 20 | Pinion gear | 22 | Engagement cleat |
| 23 | Prong | 24 | Bearing surface |
| 26 | Gear | 28 | Axle |
| 30 | Face strip | 32 | Gear reception socket |
| 40 | Drive strip | 41 | Load flange |
| 42 | Drive opening | 43 | Drive teeth |
| 44 | Punch index hole | | |
| 45 | Drive strip | 46 | Load flange |
| 47 | Drive opening | 48 | Drive teeth |
| 49 | Punch index hole | | |
| 50 | Retainer strip | 52 | Retention opening |
| 54 | Flexible flange | | |
| 60 | Stile | 62 | Backing strip |
| 64 | Axle reception socket | | |
| 70 | Louver | 72 | Stiffener |
| 74 | Cleat reception socket | 76 | |
| 100 | Shutter drive apparatus | | |
| 110 | Front case member | 112 | Gear reception socket |
| 114 | Engagement groove | | |
| 120 | Rear case member | 122 | Gear reception socket |
| 124 | Engagement ridge | | |

Figure 2:
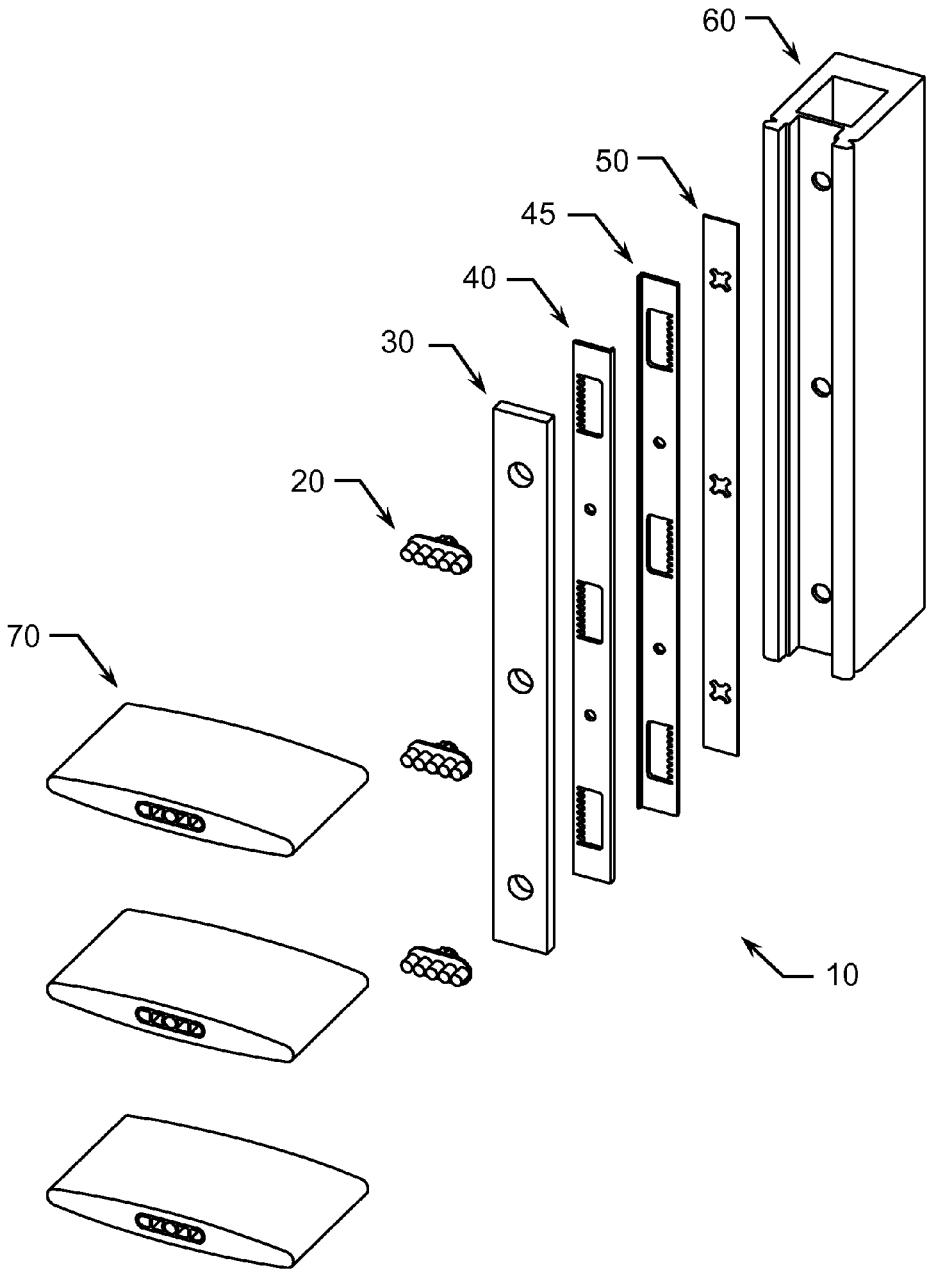
FIG. 2 is a substantially exploded trimetric view of a first embodiment of the present invention.
Figure 3:
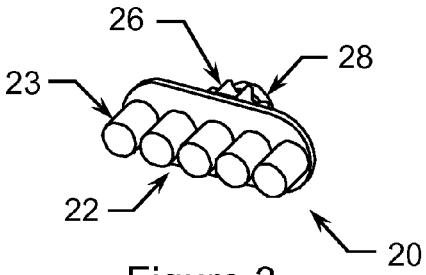
FIG. 3 is an enlarged scale view of the pinion gear shown in FIG. 2.
Figure 4:
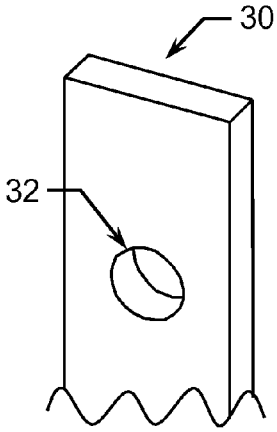
FIG. 4 is an enlarged scale view of a portion of the face strip shown in FIG. 2.
Figure 5:
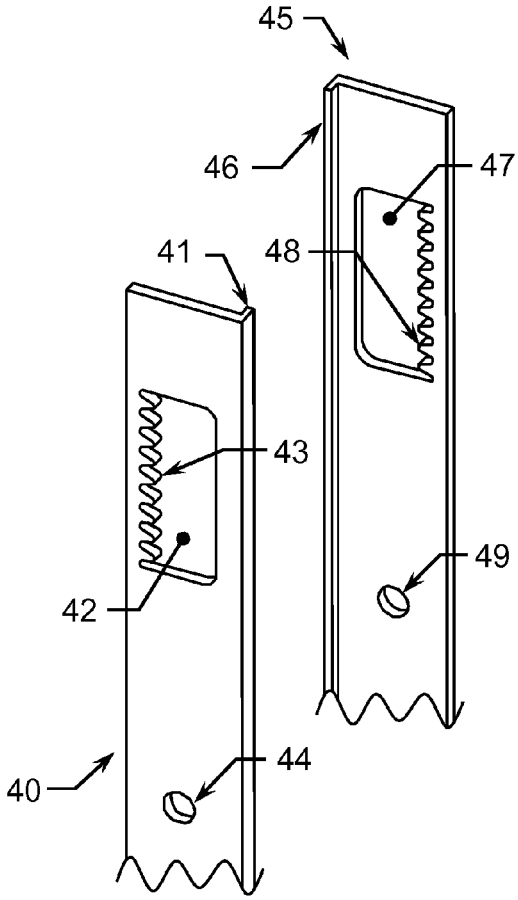
FIG. 5 is an enlarged scale view of a portion of the face strips shown in FIG. 2.
Figure 6:
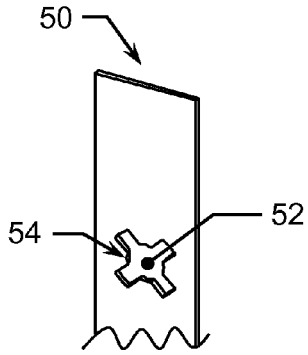
FIG. 6 is an enlarged scale view of a portion of the retainer strip shown in FIG. 2.
Figure 7:
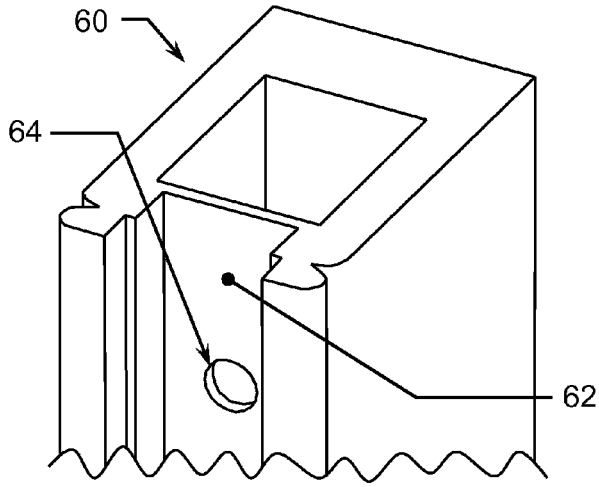
FIG. 7 is an enlarged scale view of a portion of the stile shown in FIG. 2.
Figure 8:
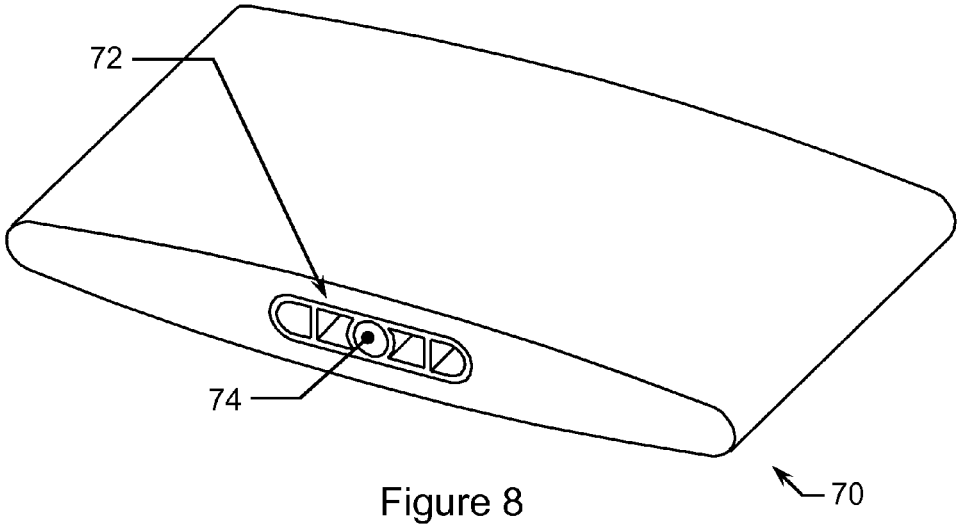
FIG. 8 is an enlarged scale view of the louver shown in FIG. 2.
Figure 9:
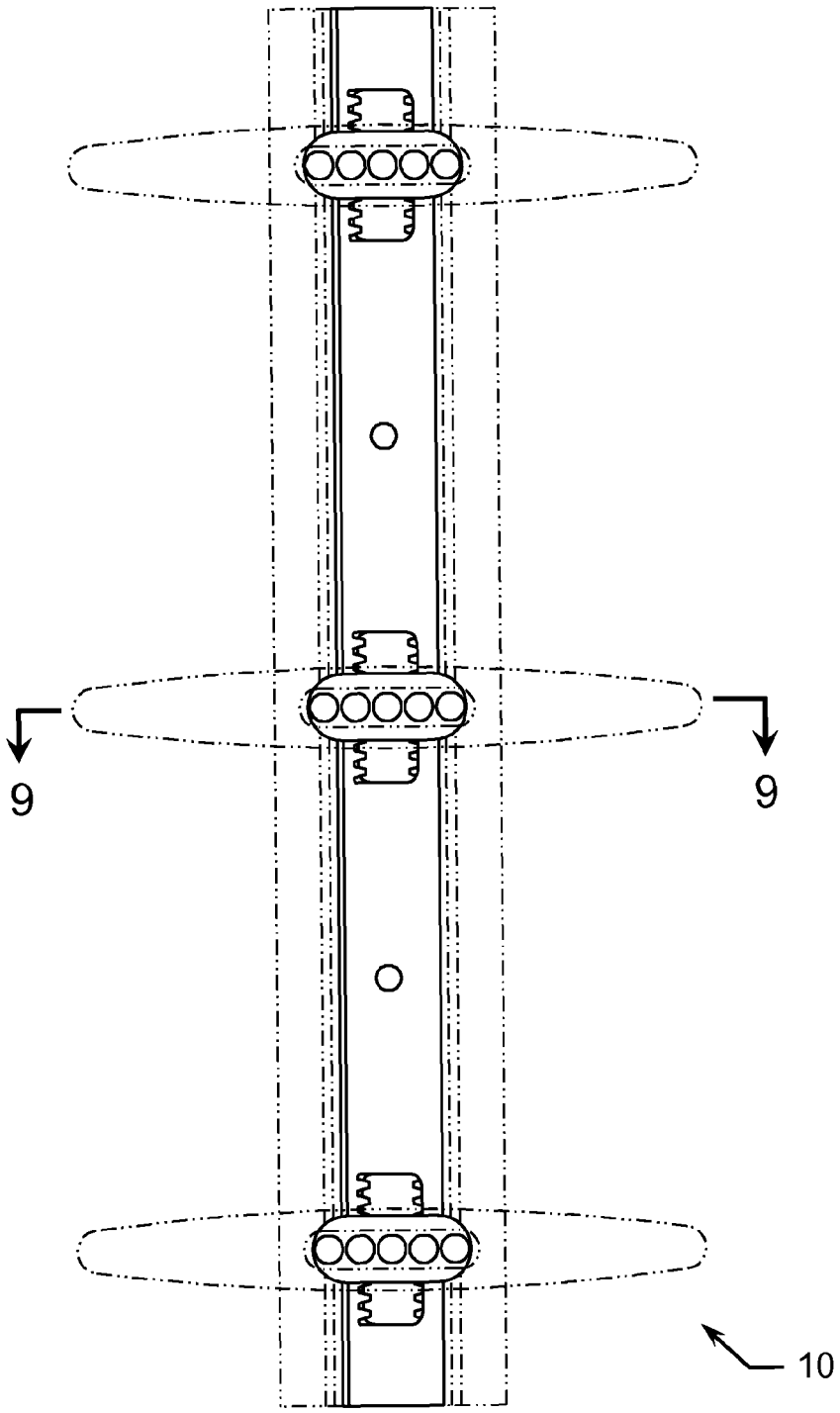
FIG. 9 is a front orthographic view of a first embodiment of the present invention with the stile and the louvers shown in phantom lines and with the louvers shown in a horizontal position.
Figure 10:
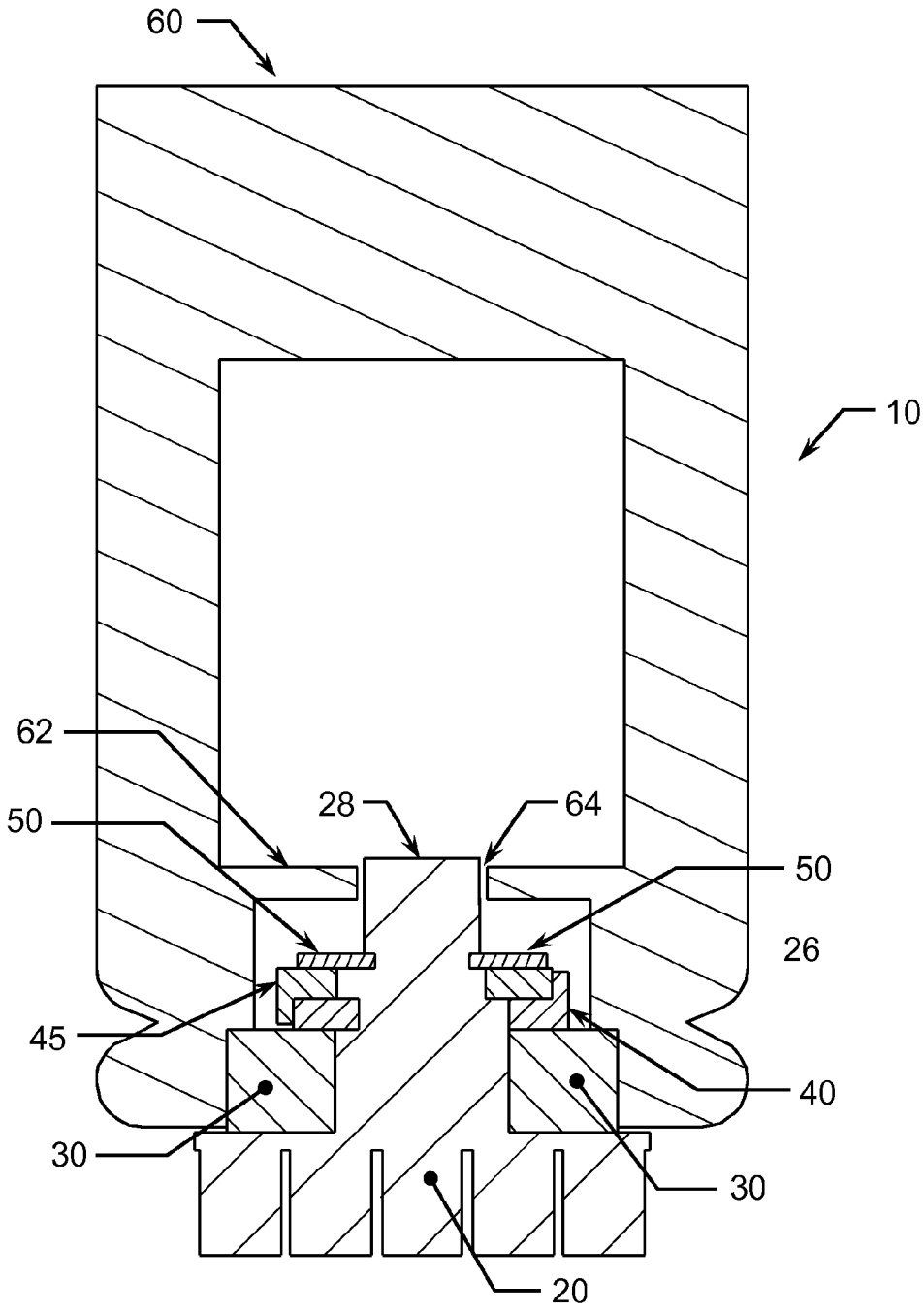
FIG. 10 is a top orthographic sectional view of a first embodiment of the present invention taken at the location of the section arrows shown in FIG. 9 and with without the louvers being shown.
Figure 11:
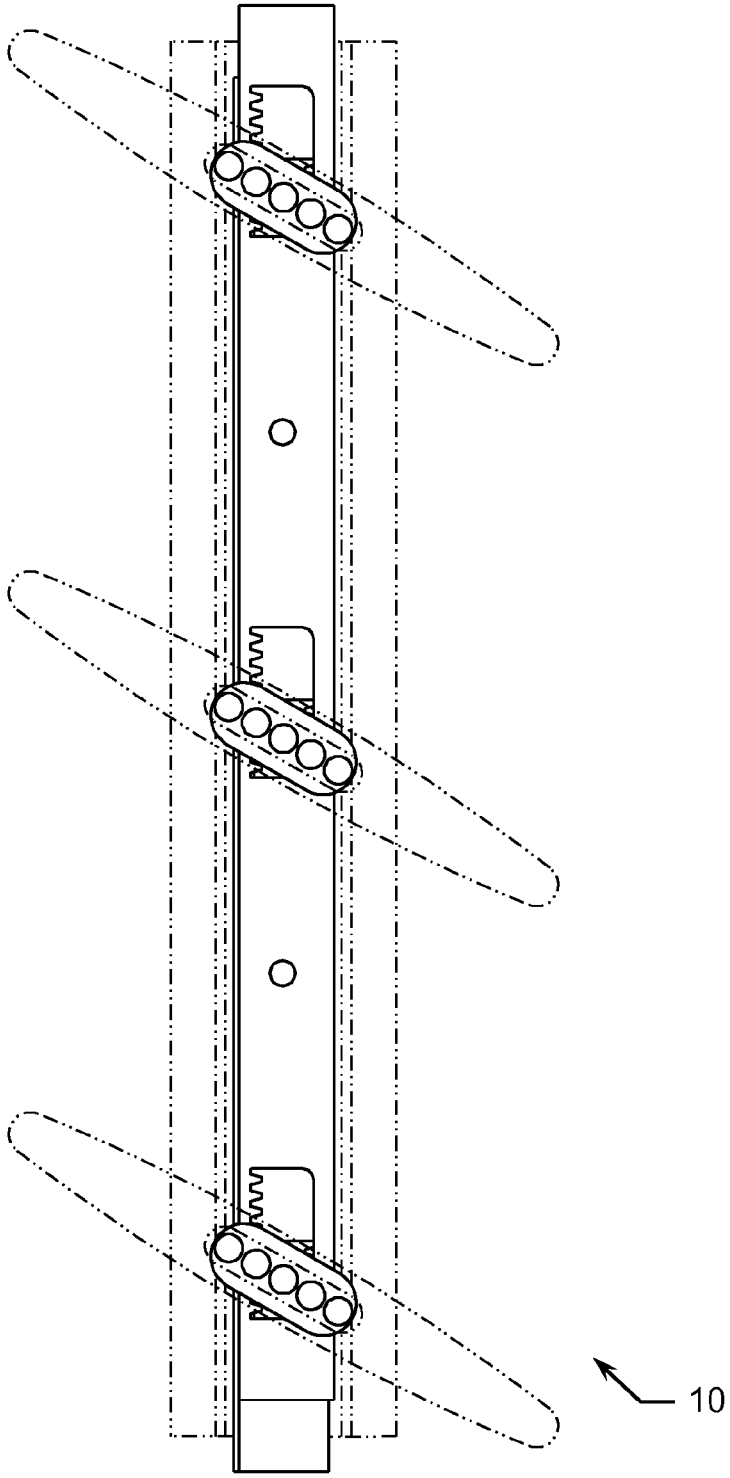
FIG. 11 is a front orthographic view of a first embodiment of the present invention with the louvers shown adjusted to a first angled position.
Figure 12:
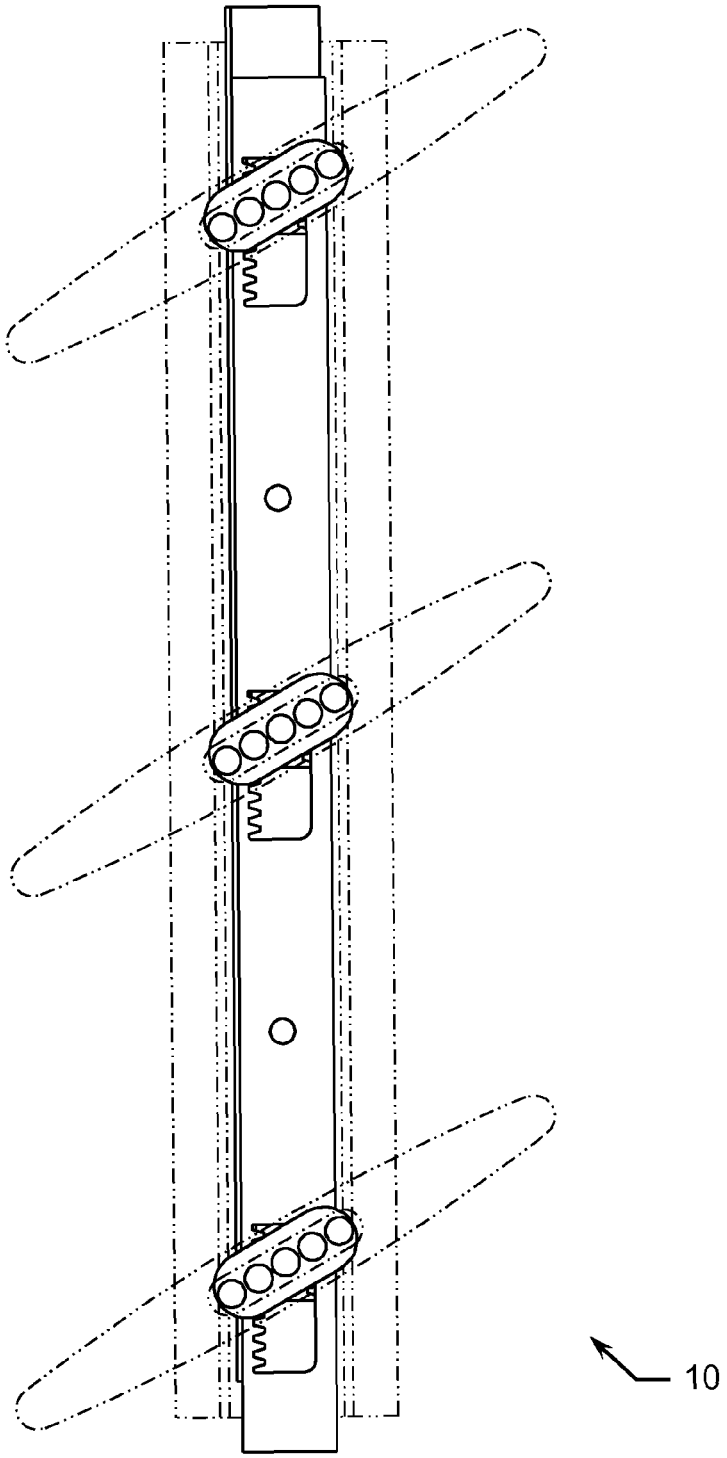
FIG. 12 is a front orthographic view of a first embodiment of the present invention with the louvers shown adjusted to a second angled position.

Referring now to the drawings and in particular to FIGS. 1 through 12, a first embodiment of the invention is a shutter drive apparatus 10 comprising a pinion gear 20, a face strip 30, a first drive strip 40, a second drive strip 45, and a retainer strip 50. Pinion gear 20 defines a preferably injection molded plastic gear having an engagement cleat 22 having a plurality of prongs 23, a bearing surface 24, a gear 26, and an axle 28. Face strip 30 defines a substantially elongated generally rectangular strip having a plurality of gear reception sockets 32. Face strip 30 may for instance be formed from wood, plastic, metal (e.g. aluminum) or, a composite thereof. Drive strip 40 defines a substantially generally elongated rectangular strip having general "L" cross-sectional shape and having a load flange 41, a plurality of drive openings 42, each drive opening 42 having a plurality of drive teeth 43, and a plurality of punch indexing holes 44. Drive strip 40 is preferably formed from an aluminum extrusion. Drive strip 45 defines a substantially generally elongated rectangular strip having general "L" cross-sectional shape and having a load flange 46, a plurality of drive openings 47, each drive opening 47 having a plurality of drive teeth 48, and a plurality of punch indexing 49. Drive strip 45 is preferably formed from an aluminum extrusion. It is noted that in order to reduce the number of different parts required for shutter drive apparatus 10, drive strips 40 and 45 are preferably substantially identical in geometry, material, and construction. It is further noted that long lengths of aluminum extrusion may be obtained with drive openings pre-punched such that a drive strip may be cut to custom lengths. Retainer strip 50 defines a preferably plastic substantially elongated generally rectangular strip having a plurality of retention openings 52, with each retention opening 52 having a plurality of flexible flanges 54. It is noted that retainer strip 50 is adapted such that retainer strip 50 may be manufactured from rolls of blank plastic strip that in turn has a plurality of retention openings 52 punched into the strip at predetermined intervals. The punched strip may then be cut to length to form retainer strip 50. Reference stile 60, defines a generally elongated stile having a backing strip 62, with backing strip 62 having a plurality of axle reception sockets 64. Reference stile 60 may be formed of wood, plastic, metal, or other materials. It is noted that backing strip 62 may be formed integrally with stile 60 or may be formed separately and then assembled to stile 60 (e.g. a wood, plastic or composite stile 60 having an assembled aluminum backing strip 62). Reference louver 70, defines a generally elongated louver having a generally centrally located stiffener 72, with stiffener 72 forming a cleat reception socket 74 on each end of louver 70. Reference louver 70 may be formed of wood, plastic, metal, or other materials. It is noted that stiffener 72 may be formed integrally with louver 70 or may be formed separately and then assembled to louver 70 (e.g. a wood, plastic or composite louver 70 having an assembled aluminum stiffener 72).

Shutter drive apparatus 10 is assembled such that pinion gears 20 are inserted into gear reception sockets 32 of face strip 30 such that bearing surfaces 24 are in rotatable engagement with gear reception sockets 32. Drive strip 40 is positioned in a first orientation against assembled face strip 30 and pinion gears 20 such that drive teeth 43 of drive strip 40 are meshed with gear 26. Drive strip 45 is positioned in a second orientation against assembled face strip 30 and pinion gears 20 such that drive teeth 48 are meshed with gear 26. With drive strips 40 and 45 thus assembled, retainer strip 50 is snappingly engaged to pinion gears 20 such that flexible flanges 54 of openings 52 are engaged to axles 28 of pinion gears 20 to retain assembled drive strips 40 and 45 while allowing for the rotation of pinion gear 20. It is noted that axles 28 may be optionally staked to assure retention of pinion gears 20. It is further noted that the assembly of Shutter drive apparatus 10 allows for the free floatation of pinion gears 20. Shutter drive apparatus 10 is preferably mounted into stile 60 and prongs 23 of engagement cleats 22 are preferably engaged in sockets 74 of louvers 70. It shall be noted that stile 60 and louver 70 preferably form a portion of an overall shutter frame (e.g. having at least two stiles, at least two rails, and a plurality of louver blades). It shall be further noted that the unique assembly of drive strips 40 and 45 provides that side separation loading of drive strip 40 is reacted by load flange 46 and side separation loading of drive strip 45 is reacted by load flange 41 such that drive strips 40 and 45 do not separate under a drive load, such that drive strips 40 and 45 move smoothly when functioning to open and close shutters, and such that the side loading of drive strips 40 and 45 is substantially evenly distributed between drive strips 40 and 45. It shall be yet further noted that with shutter drive apparatus 10 thus assembled, louvers 70 are slaved engagement to one another.

In practice, with shutter drive apparatus 10 thus assembled, shutter drive apparatus 10 functions such that a movement of any one of louvers 70 results in a like or corresponding movement of the other louvers 70. Thus in order for a user to open, close or reposition the louvers 70 of a shutter that employs shutter drive apparatus 10, the user merely grasps any one of louvers 70 and moves louver 70 to the desired position resulting in the simultaneous movement of all of louvers 70. It shall be noted that not only is shutter adjustment simple and easy but a shutter thus configured can be readily completely closed without a tilt rod inhibiting the range of motion of the shutter.

Figure 13:
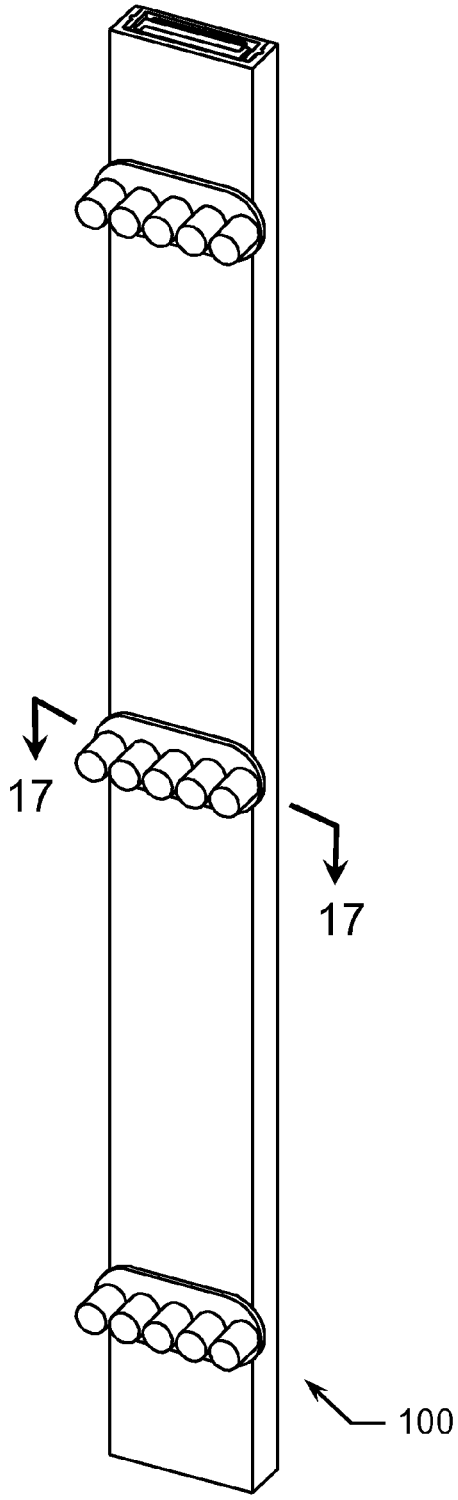
FIG. 13 is a substantially trimetric view of a second embodiment of the present invention.
Figure 14:
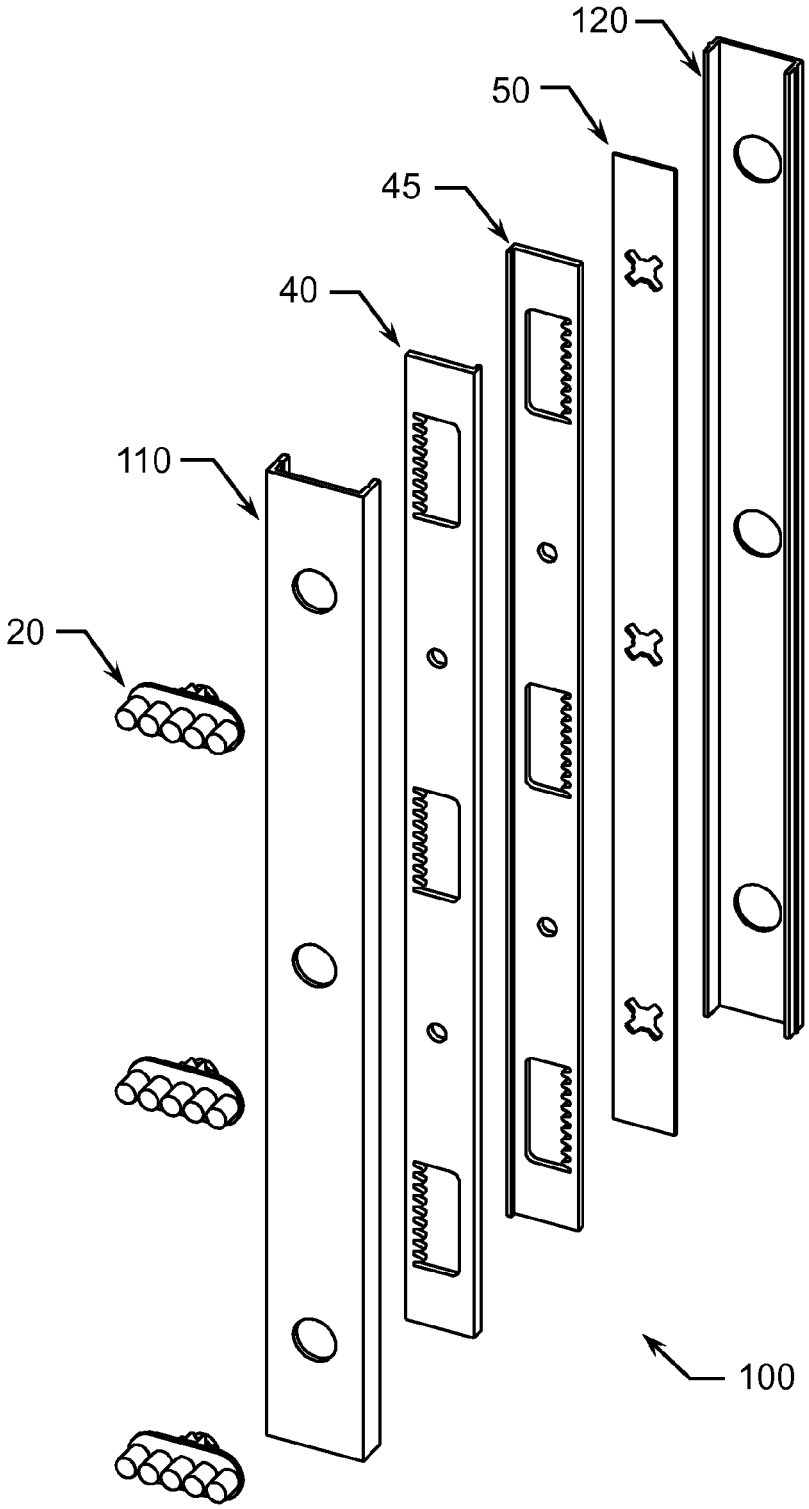
FIG. 14 is a substantially exploded trimetric view of a second embodiment of the present invention.
Figure 15:
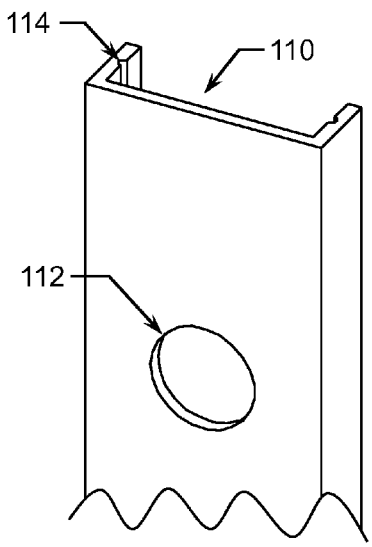
FIG. 15 is an enlarged scale view of a portion of the front case member shown in FIG. 14.
Figure 16:
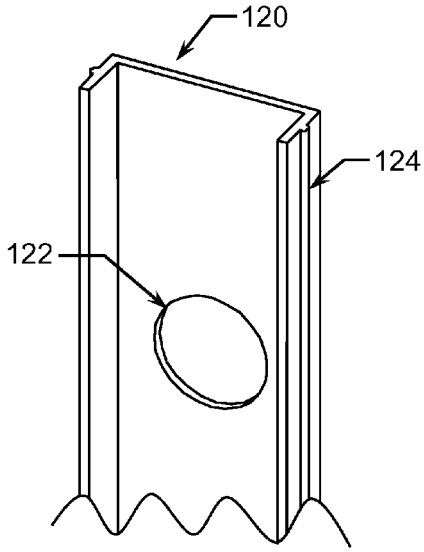
FIG. 16 is an enlarged scale view of a portion of the rear case member shown in FIG. 14.
Figure 17:
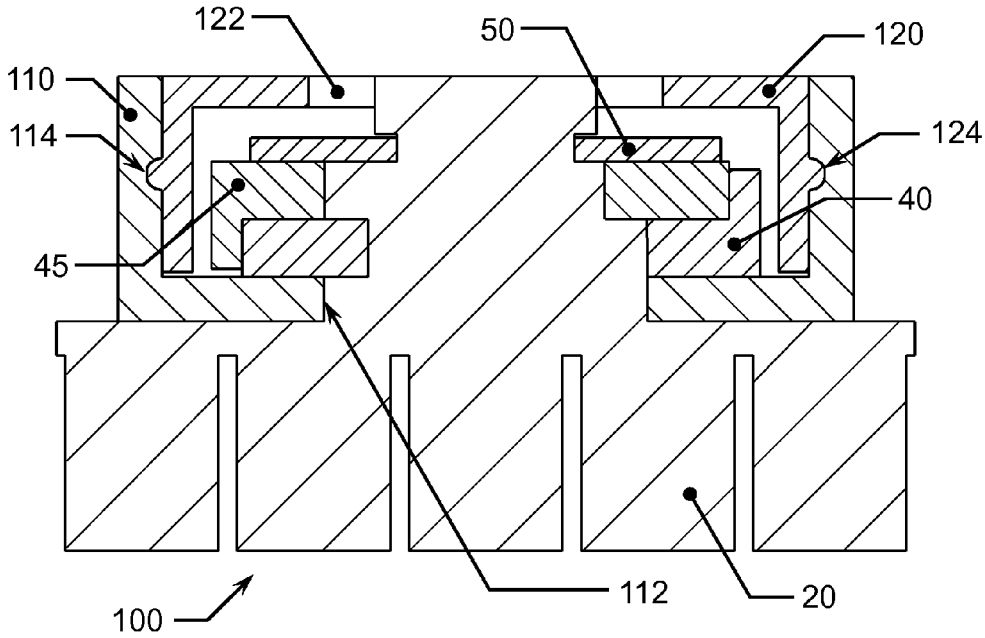
FIG. 17 is a top orthographic sectional view of a second embodiment of the present invention taken at the location of the section arrows shown in FIG. 13.

Referring now to the drawings and in particular to FIGS. 13 through 17, a second embodiment of the invention is a shutter drive apparatus 100 comprising a pinion gear 20, a front case member 110, a first drive strip 40, a second drive strip 45, a retainer strip 50, and a rear case member 120. Front case member 110 defines a substantially generally elongated rectangular member having general "C" cross-sectional shape and having a plurality of gear reception sockets 112 and a plurality of engagement grooves 114. Front case member 110 is preferably formed from an aluminum extrusion. Rear case member 120 defines a substantially generally elongated rectangular member having general "C" cross-sectional shape and having a plurality of gear reception sockets 122 and a plurality of engagement ridges 124. Rear case member 120 is preferably formed from an aluminum extrusion.

Shutter drive apparatus 100 is assembled such that pinion gears 20 are inserted into gear reception sockets 112 of front case member 110 such that bearing surfaces 24 are in rotatable engagement with gear reception sockets 112. Drive strip 40 is positioned in a first orientation against assembled front case member 110 and pinion gears 20 such that drive teeth 43 of drive strip 40 are meshed with gear 26. Drive strip 45 is positioned in a second orientation against assembled front case member 110 and pinion gears 20 such that drive teeth 48 are meshed with gear 26. With drive strips 40 and 45 thus assembled, retainer strip 50 is snappingly engaged to pinion gears 20 such that flexible flanges 54 of openings 52 are engaged to axles 28 of pinion gears 20 to retain assembled drive strips 40 and 45 while allowing for the rotation of pinion gear 20. It is noted that axles 28 may be optionally staked to assure retention of pinion gears 20. Rear case member 120 is further snappingly engaged to front case member 110 such that engagement ridges 124 seat within engagement grooves 114 and such that pinion gears 20 are free to rotate within gear reception sockets 122. It is noted that the assembly of Shutter drive apparatus 100 allows for the free floatation of pinion gears 20. Shutter drive apparatus 100 is preferably mounted into stile 60 and prongs 23 of engagement cleats 22 are preferably engaged in sockets 74 of louvers 70. It shall be noted that stile 60 and louver 70 preferably form a portion of an overall shutter frame (e.g. having at least two stiles, at least two rails, and a plurality of louver blades). It shall be further noted that the unique assembly of drive strips 40 and 45 provides that side separation loading of drive strip 40 is reacted by load flange 46 and side separation loading of drive strip 45 is reacted by load flange 41 such that drive strips 40 and 45 do not separate under a drive load, such that drive strips 40 and 45 move smoothly when functioning to open and close shutters, and such that the side loading of drive strips 40 and 45 is substantially evenly distributed between drive strips 40 and 45. It shall be yet further noted that with shutter drive apparatus 100 thus assembled, louvers 70 are slaved engagement to one another.

In practice, with shutter drive apparatus 100 thus assembled, shutter drive apparatus 100 functions such that a movement of any one of louvers 70 results in a like or corresponding movement of the other louvers 70. Thus in order for a user to open, close or reposition the louvers 70 of a shutter that employs shutter drive apparatus 100, the user merely grasps any one of louvers 70 and moves louver 70 to the desired position resulting in the simultaneous movement of all of louvers 70. It shall be noted that not only is shutter adjustment simple and easy but a shutter thus configured can be readily completely closed without a tilt rod inhibiting the range of motion of the shutter.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A shutter drive apparatus for use in adjusting the louvers of a tilt-rod-less shutter, said apparatus having a first drive strip, a second drive strip, and a plurality of pinion gears, wherein each of said drive strips defines a generally elongated strip having a flange and a plurality of drive openings, each of said drive openings having a plurality of drive teeth positioned on a first side of said drive strip in said drive opening, and wherein each of said pinion gears defines a pinion gear having an axle and a gear member having a plurality of teeth, and wherein said apparatus is assembled such that said first and second drive strips are positioned in relative slidable contact with each other with each drive opening of said first drive strip at least partially overlapping with a corresponding drive opening of said second drive strip, and such that a pinion gear is drivably positioned in each of said at least partially overlapping drive openings such that said teeth of said positioned pinion gears are drivably meshed with the teeth of both of said at least partially overlapping drive openings within which said pinion gears are drivably positioned.

2. The apparatus of claim 1, wherein said apparatus is adapted such that movement of said first drive strip in a first direction results in synchronous movement of said second drive strip in a second direction and synchronous rotation of said pinion gears.

3. The apparatus of claim 1, wherein said flange of said first drive strip reacts side separation loading of said second drive strip and said flange of said second drive strip reacts side separation loading of said first drive strip.

4. The apparatus of claim 1, wherein each of said pinion gears include an engagement cleat having a plurality of prongs extending therefrom.

5. The apparatus of claim 1, wherein said apparatus further includes at least one retainer, and wherein said apparatus is assembled such that said axle of each of said pinion gears is rotatably retained in a retention opening of said retainer.

6. The apparatus of claim 1, wherein said pinion gears are adapted so as to be snappingly removable and reattachable to said drive strips.

7. The apparatus of claim 1, wherein said apparatus is mounted within a stile of a frame of a shutter, and wherein said pinion gears are drivably engaged to louvers of said shutter such that movement of a first louver results in synchronous movement of other louvers of said shutter.

8. A shutter drive apparatus for use in adjusting the louvers of a tilt-rod-less shutter, said apparatus having a first drive strip, a second drive strip, a plurality of pinion gears, and at least one retainer, wherein each of said drive strips defines a generally elongated strip having a plurality of drive openings, each of said drive openings having a plurality of drive teeth positioned on a first side of said drive strip in said drive opening, and wherein each of said pinion gears defines a pinion gear having an axle and a gear member having a plurality of teeth, and wherein said retainer defines a generally elongated strip having a plurality of retention openings, and wherein said apparatus is assembled such that said first and second drive strips are positioned in relative slidable contact with each other with each drive opening of said first drive strip at least partially overlapping with a corresponding drive opening of said second drive strip, and such that a pinion gear is drivably positioned in each of said at least partially overlapping drive openings such that said teeth of said positioned pinion gears are drivably meshed with the teeth of both of said at least partially overlapping drive openings within which said pinion gears are drivably positioned, and such that said axle of each of said pinion gears is rotatably retained in a retention opening of said retainer strip.

9. The apparatus of claim 8, wherein said apparatus is adapted such that movement of said first drive strip in a first direction results in synchronous movement of said second drive strip in a second direction and synchronous rotation of said pinion gears.

10. The apparatus of claim 8, wherein each of said drive strips include a flange extending therefrom, and wherein said flange of said first drive strip reacts side separation loading of said second drive strip and said flange of said second drive strip reacts side separation loading of said first drive strip.

11. The apparatus of claim 8, wherein each of said pinion gears include an engagement cleat having a plurality of prongs extending therefrom.

12. The apparatus of claim 8, wherein said pinion gears are adapted so as to be snappingly removable and reattachable to said drive strips.

13. The apparatus of claim 8, wherein said apparatus is mounted within a stile of a frame of a shutter, and wherein said pinion gears are drivably engaged to louvers of said shutter such that movement of a first louver results in synchronous movement of other louvers of said shutter.

14. A shutter drive apparatus for use in adjusting the louvers of a tilt-rod-less shutter, said apparatus having a front case member, a first drive strip, a second drive strip, a plurality of pinion gears, and a rear case member, wherein each of said drive strips defines a generally elongated strip having a flange and a plurality of drive openings, each of said drive openings having a plurality of drive teeth positioned on a first side of said drive strip in said drive opening, and wherein each of said pinion gears defines a pinion gear having an axle and a gear member having a plurality of teeth, and wherein said apparatus is assembled such that said first and second drive strips are positioned in relative slidable contact with each other with each drive opening of said first drive strip at least partially overlapping with a corresponding drive opening of said second drive strip, and such that a pinion gear is drivably positioned in each of said at least partially overlapping drive openings such that said teeth of said positioned pinion gears are drivably meshed with the teeth of both of said at least partially overlapping drive openings within which said pinion gears are drivably positioned, and such that said front case member and said second case member are removably engaged to each other such that each of said pinion gears is rotatably positioned within a gear reception socket of said front case member and within a gear reception socket of said rear case member.

15. The apparatus of claim 14, wherein said apparatus is adapted such that movement of said first drive strip in a first direction results in synchronous movement of said second drive strip in a second direction and synchronous rotation of said pinion gears.

16. The apparatus of claim 15, wherein said flange of said first drive strip reacts side separation loading of said second drive strip and said flange of said second drive strip reacts side separation loading of said first drive strip.

17. The apparatus of claim 15, wherein each of said pinion gears include an engagement cleat having at least four substantially cylindrical shaped prongs extending therefrom.

18. The apparatus of claim 15, wherein said apparatus further includes at least one retainer, and wherein said apparatus is assembled such that said axle of each of said pinion gears is rotatably retained in a retention opening of said retainer.

19. The apparatus of claim 15, wherein said pinion gears are adapted so as to be snappingly removable and reattachable to said drive strips.

20. The apparatus of claim 15, wherein said apparatus is mounted within a stile of a frame of a shutter, and wherein said pinion gears are drivably engaged to louvers of said shutter such that movement of a first louver results in synchronous movement of other louvers of said shutter.

* * * * *